US008438894B2

(12) United States Patent
Hansen

(10) Patent No.: US 8,438,894 B2
(45) Date of Patent: May 14, 2013

(54) PRESS BRAKE FOR BENDING SHEETS

(75) Inventor: Bjarne Hansen, Pontvallain (FR)

(73) Assignee: Amada Co., Ltd., Kanagawa (JP)

( * ) Notice: Subject to any disclaimer, the term of this patent is extended or adjusted under 35 U.S.C. 154(b) by 511 days.

(21) Appl. No.: 12/722,003

(22) Filed: Mar. 11, 2010

(65) Prior Publication Data

US 2010/0229622 A1 Sep. 16, 2010

(30) Foreign Application Priority Data

Mar. 13, 2009 (FR) ..... 09 51609
Jul. 22, 2009 (FR) ..... 09 55130

(51) Int. Cl.
*B21D 9/14* (2006.01)

(52) U.S. Cl.
USPC ..... 72/390.4; 72/389.1; 72/481.1; 72/482.3; 100/257; 100/291

(58) Field of Classification Search ..... 72/386, 72/389.1–389.4, 390.4, 390.5, 481.1, 482.3; 100/257, 291
See application file for complete search history.

(56) References Cited

U.S. PATENT DOCUMENTS 4,331,020 A * 5/1982 Cros ..... 72/461
4,590,784 A * 5/1986 Okabe et al. ..... 72/389.3
4,732,032 A * 3/1988 Kogure ..... 72/389.5
4,890,476 A * 1/1990 Takahashi et al. ..... 72/456
5,067,340 A * 11/1991 MacGregor ..... 72/389.5
5,193,452 A * 3/1993 Dieperink ..... 100/46
5,857,366 A * 1/1999 Koyama ..... 72/31.1
6,374,658 B1 * 4/2002 Gascoin et al. ..... 72/389.5
6,401,512 B1 * 6/2002 Gascoin ..... 72/389.5
6,519,996 B1 * 2/2003 Gasparini ..... 72/389.5
6,959,581 B2 * 11/2005 Kanno ..... 72/389.5
2007/0033981 A1 * 2/2007 Gerritsen et al. ..... 72/389.5

FOREIGN PATENT DOCUMENTS

EP 1112130 4/2002
EP 1452302 9/2004
JP 2000 343125 12/2000

(Continued)

OTHER PUBLICATIONS

French Preliminary Search Report corresponding to French application No. 0951609 dated Dec. 11, 2009.

(Continued)

*Primary Examiner* — Dana Ross
*Assistant Examiner* — Onekki Jolly
(74) *Attorney, Agent, or Firm* — Kilpatrick Townsend & Stockton LLP

(57) ABSTRACT

The present invention relates to a bending press comprising an upper table (130) and a lower table (132) placed edge-to-edge in the vertical direction, with one of the tables being movable relative to the other in the vertical direction, and with one of the tables presenting slots (134, 136) that are placed symmetrically relative to the midplane (P'P). Each slot has an open outside end and comprises a first slot portion (135*a*, 137*a*) and a second slot portion (135*b*, 137*b*) that is situated on the inside relative to the first slot portion and that is connected thereto, the shapes of said slot portions being such that the stiffness of the table portion situated between the slot and the tool fastener is greater between the first slot portion and the tool fastener than between the second slot portion and the tool fastener. At least one element (180) for adjusting the flexing of said table is disposed in the first slot portion.

13 Claims, 13 Drawing Sheets

FOREIGN PATENT DOCUMENTS

| | | | |
|---|---|---|---|
| JP | 2000-343125 | * | 12/2000 |
| JP | 2001 071033 | | 3/2001 |
| JP | 2001 121214 | | 5/2001 |
| JP | 2001-121214 | * | 8/2001 |
| WO | 01/43896 | | 6/2001 |
| WO | WO 01/43896 | * | 6/2001 |

OTHER PUBLICATIONS

French Preliminary Search Report corresponding to French application No. 0955130 dated Apr. 7, 2010.

* cited by examiner

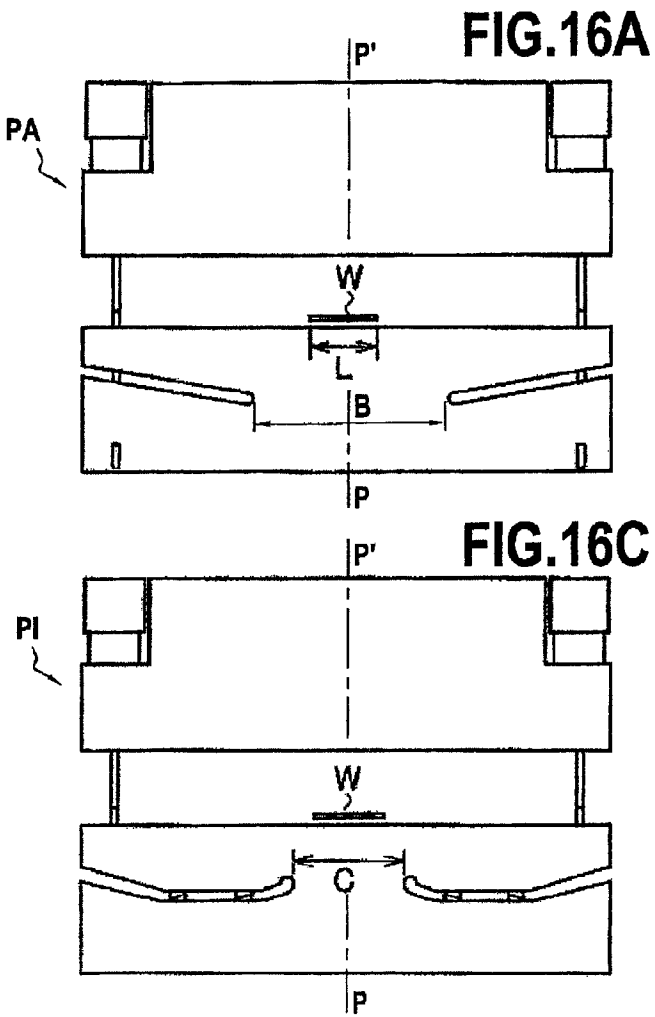
FIG.16A
PA
P'
W
L
B
P
FIG.16C
PI
P'
W
C
P
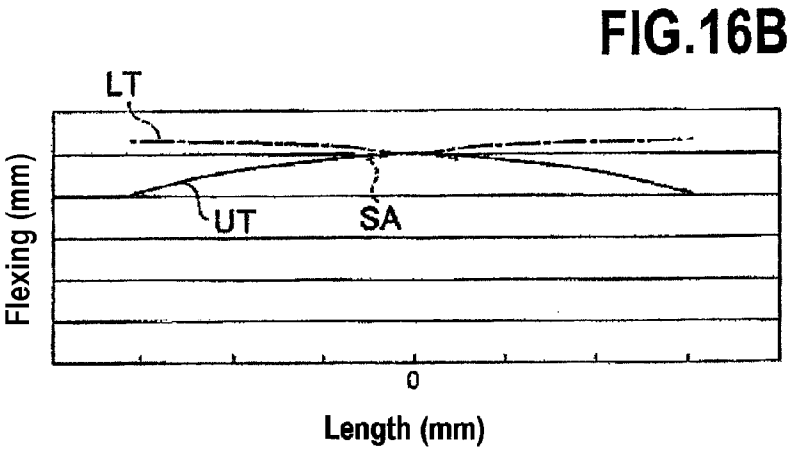
FIG.16B
Flexing (mm)
LT
UT
SA
0
Length (mm)
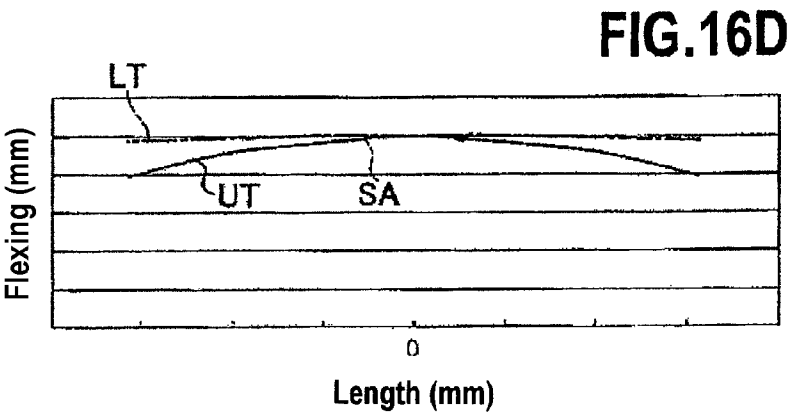
FIG.16D
Flexing (mm)
LT
UT
SA
0
Length (mm)

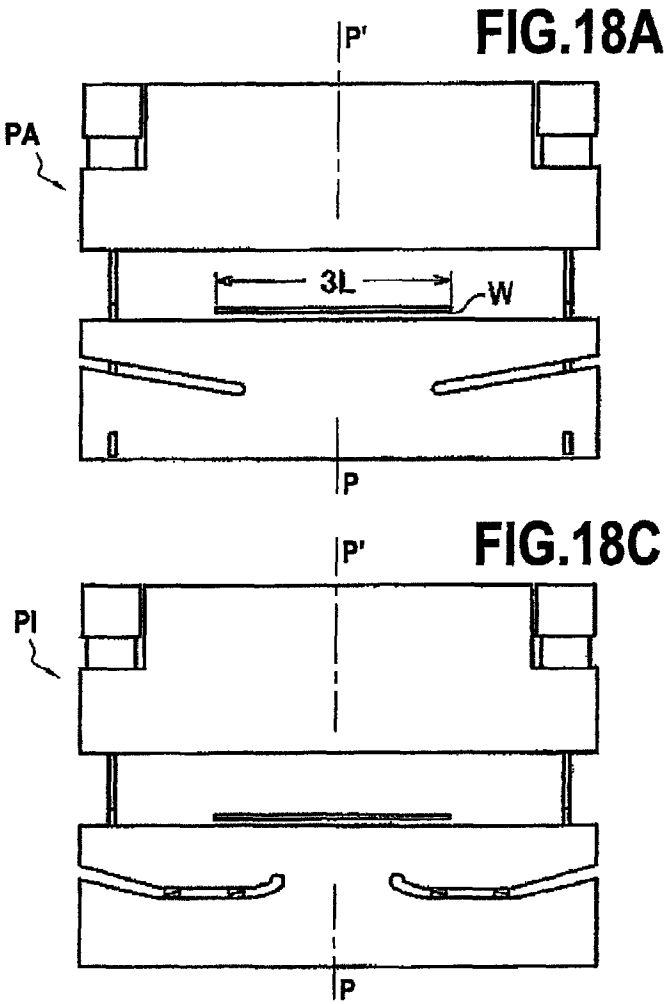
FIG.18A
PA
P'
P
3L
W
FIG.18C
PI
P'
P
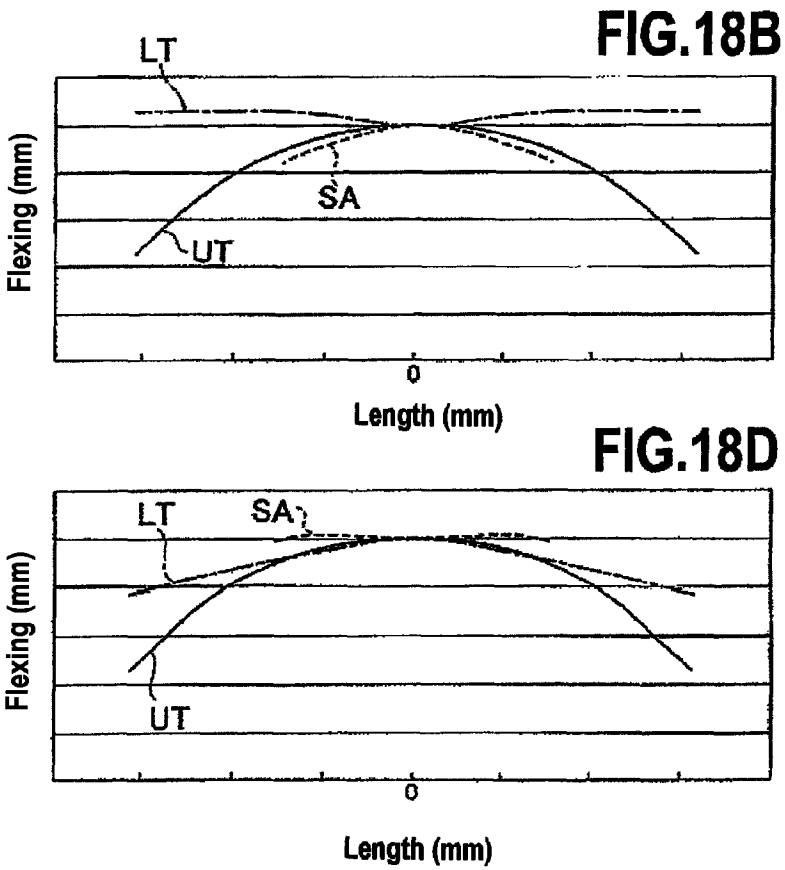
FIG.18B
Flexing (mm)
Length (mm)
0
LT
SA
UT
FIG.18D
Flexing (mm)
Length (mm)
0
LT
SA
UT

PA
P'
P
4L
W

Flexing (mm)
Length (mm)
0
LT
SA
UT

PI
P'
P

Flexing (mm)
Length (mm)
0
SA
LT
UT

PRESS BRAKE FOR BENDING SHEETS

FIELD OF THE INVENTION

The present invention relates to a bending press or "press brake" having tables with controlled deformation.

BACKGROUND OF THE INVENTION

Bending presses are machine tools of a type that is itself well known. As shown in accompanying FIG. 1A, the machine tool comprises a lower table 12 and an upper table 14 that is movable relative to the lower table 12. Usually, the lower table 12 is stationary and the upper table 14 is suitable for being moved towards the lower table 12 under drive from actuators $V_1$ and $V_2$ that act on the ends 14*a* and 14*b* of the upper table. Usually, the lower table 12 has its free edge 12*a* fitted with fastener means 16 for fastening bending matrices 18. In the same way, the edge 14*c* of the upper table 14 is fitted with fastener means 20 for fastening bending punches 22.

A metal sheet or lamination F is placed on the bending matrices 18 of the lower table 12. The sheet F may be of a length L that varies widely depending on circumstances. Under drive from the pistons of the actuators $V_1$ and $V_2$, the punches 22 mounted on the upper table move towards the sheet F placed on the matrices of the lower table. As soon as the punch comes into contact with the sheet, force begins to increase within the metal lamination or sheet F as the punch penetrates therein, initially in the elastic range and subsequently in the plastic range, thereby enabling the sheet to be bent permanently.

Because the force is applied to the upper table by the actuators $V_1$ and $V_2$ acting on the ends of the table, the linear load distributed between the two ends of the tables corresponds the upper table being deformed along a line in the form of a concave arc with deformation maximas close to the midplane of the table. This means that for bending purposes, at the end of bending, the central portions of the punches have penetrated into the sheet less than have the end portions. If bending were to be performed on a matrix that, itself, were to remain perfectly straight during bending, then a metal lamination or sheet F would be obtained having a bend angle that was wider in its central portion than at its ends. Such a result would naturally be unacceptable.

In reality, the matrices carried by the lower table, or more precisely by the free edge of the lower table, are in fact subjected to deformation during bending, which deformation is likewise concave with its maximum in the central portion. The result of these two deformations is that, in reality, the bending obtained in the sheet is very open in the middle portion of the press and very closed at its ends. In reality, the difference may reach an angle of several degrees, e.g. 93° at the midplane of the tables and 90° at its ends. The resulting sheet thus presents poor accuracy concerning the linearity of its bend, thus giving it a so-called "boat" shape.

In order to remedy that drawback, various solutions have been proposed for the purpose of controlling these deformations at the edges of the tables by using various means in order to obtain a bend that is substantially identical over the entire length of the bent metal lamination or sheet F.

Usually, these solutions involve providing slots, such as the slots 24 and 26 shown in FIG. 1A, that are formed in the lower table symmetrically about the midplane of the press. These slots then define a central zone 28 of the lower table that is slot-free and that presents a length $l_0$ together with two slots 24 and 26, each of length a.

With slots 24 and 26 of conventional type, i.e. that leave between them a slot-free portion 28 of long length $l_0$, substantially parallel deformations $D_1$ and $D_2$ are indeed obtained for the edges of the upper and lower tables 14 and 12, as shown in FIG. 1B. This ensures that proper bending is achieved. Nevertheless, this result is obtained only when the metal lamination or sheet for bending has a length that is substantially equal to the total length of the lower or upper tables. In contrast, with the known solutions and as shown in FIG. 1C, when the length of the sheet is shorter than the total length of the lower or upper table, both of the deformations $D'_1$ and $D'_2$ are concave. Japanese utility model 2 558 928 in the name of AMADA CORPORATION describes a solution in which both slots in the lower table are provided with respective movable members of positions that are adjustable within the slots. Those movable members are directly in contact with the bottom and top edges of the slots. Nevertheless, that solution enables satisfactory results to be obtained only for certain lengths of metal sheet relative to the total length of the press, but not for others. Furthermore, it does not take into consideration problems associated with the fact that the metal sheet may occupy a position that is asymmetrical relative to the midplane of the bending press, while nevertheless enabling a bend to be obtained that is identical along the entire length of the metal sheet.

In European patent EP 1 112 130, there is proposed a solution of fitting each slot of the lower table with a mover member connecting together the free top portion and the stationary bottom portion of the lower table so as to cause the top wall of the slot to approach the bottom wall thereof, assuming the bottom wall is stationary. This enables the curvature of the deformation of the free top portion of the lower table carrying the matrices to be modified in controlled manner, in the absence of any stress being applied to the tables. The drawback of that solution is that it requires a complex hydraulic control installation to be put into place.

Similar solutions are disclosed in documents JP 2001-71033, JP 2000-343125, and WO 01/43896.

OBJECT AND SUMMARY OF THE INVENTION

An object of the present invention is to provide a bending press including a system for correcting the deformation of the edges of the tables, which system remedies the above-mentioned drawbacks, and in particular makes it possible to obtain substantially parallel deformation of the edges of the upper and lower tables over a range of lengths of metal sheet for bending that is very wide compared with the length of the tables of the press, and regardless of whether the metal sheet for bending is positioned the symmetrically or asymmetrically relative to the midplane of the press, for a given adjustment of the machine; and/or makes it possible to obtain very high bending accuracy even for sheets of very great length and made of materials that have the reputation of being difficult to bend.

To achieve this object, in a first aspect of the invention, the bending press for bending metal sheets comprises:

an upper table having a bottom edge carrying first bending tools, and a lower table having a top edge carrying second bending tools, the two tables being movable relative to each other to exert a bending force on the sheet;

said press presenting a vertical midplane, one of said tables presenting two slots through its entire thickness and disposed symmetrically relative to the midplane, each slot having an open first end opening out in a side edge of the table and a closed end, the closed ends defining a slot-free table portion of length $l_0$; wherein said press:

also includes an even number of stoppers, each stopper being disposed in one of the slots at a fixed distance from the closed ends, and the stoppers being disposed symmetrically about the midplane, said stoppers presenting a predetermined coefficient of elasticity;

each stopper defining in the zone of the slot in which it is located, a possibility of controlled approach of the two edges of the slot under the effect of the load applied to the table including the slots, said approach resulting from at least one of two parameters consisting in clearance j initially provided by said stopper in the slot in the absence of an applied load and the elastic deformation of said stopper, the possibility of approach created by a stopper closer to the closed end being smaller than that of any stopper closer to the open end;

the possibilities of approach of the edges of the slot corresponding to the stoppers and their positions in the slots being determined in such a manner that, at the end of application of the bending force by the movable table against the other table via the sheet, the curves of the edges of the tables are substantially parallel to each other.

The invention is applicable to all types of bending press regardless of whether the movable table is the upper table or the lower table. Likewise, the correcting slots may be formed in the upper table or in the lower table.

Nevertheless, the most common configuration is that in which the upper table is the moving table and the slots are formed in the lower table.

It should be understood, that because of the presence of the stopper(s) in each slot, substantially parallel deformation of the edges of the upper and lower tables is obtained when working on metal sheets of great length (i.e. extending not only through the slot-free portion of the table, but also over substantial fractions of the slots). This is because, given the initial clearance that is provided (in the absence of stress being applied to the table) and/or given the elastic deformation of the stoppers, the stress that is applied to the table including the slots gives rise progressively to a controlled approach of the edges of the slot. By appropriately adapting firstly the position(s) of the stopper(s) in each slot and secondly the clearance created by each stopper and/or the capacity of the stopper itself for elastic deformation, it is indeed possible to obtain parallel deformation of the edges of the upper and lower tables, even when the length of the metal sheet for bending is long and even if the sheet is off-center relative to the midplane P'P of the press.

Provision may be made for at least some of the stoppers to be placed without significant clearance in their respective slots in the absence of any applied load, with the deformation of the slot then being associated solely with the deformation capacity of the stopper. It is also possible to make provision for such clearance to be present, with the slot then deforming freely to begin with, followed by deformation of the stopper.

In one embodiment, the force applied to the movable table is applied to both ends thereof in such a manner that the same travel stroke is applied to both ends, and two symmetrical stoppers present the same possibility of controlled approach.

This embodiment is particularly well adapted to circumstances in which the metal sheet for bending occupies a symmetrical position relative to the midplane of the press.

In an embodiment of the first aspect of the invention, the force applied to the movable table is applied to both ends thereof in such a manner that different travel strokes are applied to both ends and two symmetrical stoppers present the same possibility of controlled approach.

According to one possibility made available by the invention, two symmetrical stoppers present different possibilities of controlled approach.

This embodiment is well adapted to circumstances in which the metal sheet occupies a position that is asymmetrical relative to the midplane P'P of the press. This is because the asymmetrical nature of the position of the sheet is then compensated by the different travel lengths of the two ends of the movable table.

More preferably, the press has four stoppers, with two stoppers being provided in each slot. The stoppers may define clearances j that are controllable.

This disposition enables the deformation of the table to be controlled at two distinct points within the slot. It is therefore particularly well adapted to tables of great length, typically presenting lengths of 2.5 meters (m), 3 m, or longer.

The initial adjustment of the positions of the stoppers in the slots is appropriate for a very large number of bending situations. Nevertheless, in certain circumstances, it may be necessary to modify these adjustments, so it is advantageous for the stoppers to enable the clearances they define to be modified easily.

According to one possibility, at least one of the stoppers defines clearance that is equal to zero. Preferably, the stoppers define clearance that is less than 1 millimeter (mm). In most circumstances, the clearance will in fact be less than 0.3 mm.

In a preferred embodiment, it is possible to make provision for the stoppers to be capable of occupying positions in a controllable manner as a function of the particular length of a sheet for bending, while nevertheless presenting positions that are stationary while the press is in use. The positions to be occupied by the stoppers as a function of the sheet for bending may be determined with the help of three-dimensional mathematical models.

In a preferred embodiment of the bending press, in accordance with the first aspect of the invention, each stopper comprises:

a first wedge having a stationary first end secured to a first edge of a slot and a second end forming a first inclined surface that is inclined relative to the direction of the slot, and a second wedge having a first end connected to the second edge of the slot but movable relative to the edge of the slot along the direction thereof, and a second end forming an inclined surface that is parallel to the first inclined surface, clearance existing between said surfaces in the absence of any load being applied to the table, whereby, by moving said second wedge, it is possible to adjust the value of the clearance between the two wedges in the absence of any load applied to the table that includes the slots.

A bending press of a second aspect of the invention comprises an upper table provided with a fastener for top tools and a lower table provided with a fastener for bottom tools, the two tables being placed edge-to-edge in the vertical direction, and one of the tables being movable relative to the other in the vertical direction, one of the tables presenting slots disposed symmetrically relative to the midplane, each slot having an open outside end; wherein each of said slots comprises a first slot portion and a second slot portion that is situated on the inside relative to the first slot portion and that is connected thereto, the shapes of said slot portions being such that the stiffness of the portion of the table situated between the slot and the tool fastener is greater between the first slot portion and the tool fastener than it is between the second slot portion and the tool fastener, and wherein at least one element for adjusting the flexing of said table is disposed in the first slot portion.

As can be understood on reading of the detailed description, these characteristics make it possible to obtain high bending accuracy, both with sheets of great width, comparable to the length of the tables, and with sheets of smaller width, by ensuring that the edges of the lower and upper tables deform substantially in parallel.

Advantageously, the vertical distance between the inside end of the first slot portion whereby the first slot portion is connected to the second slot portion, and the tool fastener, is greater than the vertical distance between the inside end of the second slot portion and the tool fastener.

Advantageously, the first and second slot portions are inclined relative to each other. Under such circumstances, and advantageously, the first slot portion presents, over at least a segment of said first portion, a general direction that is horizontal, while at least the inside end of the second slot portion, remote from the first slot portion, is oriented towards the tool fastener. It is then also advantageous for the second slot portion to be inclined towards the tool fastener.

Furthermore, and advantageously, the second slot portion presents a curved shape with its concave side directed towards the tool fastener.

Advantageously, the second slot portion presents a staircase shape.

Advantageously, the first slot portion presents a general direction that is horizontal, and the inside end of the second slot portion is oriented substantially horizontally towards the vertical midplane of the table.

Advantageously, the second slot portion presents at least one portion that is flared going away from the first slot portion.

Advantageously, the first slot portion includes an outer slot portion that is inclined so as to be closer to the tool fastener than is an inner portion of the first slot portion.

Advantageously, at least one of the slot portions presents a width, as measured vertically, that varies along the zone of said slot portion in which the width is measured.

Advantageously, the inner ends of the first slot portions are positioned in such a manner that while bending a sheet, of width substantially equal to the length of the upper or lower table, the difference in height between the upward convex flexing peak in the middle of the lower table and the two side ends of the lower table remains within a predetermined tolerance.

Advantageously, the inner ends of the second slot portions are positioned in such a manner that while bending a sheet placed in the middle of the length of the tables, and of width shorter than the length of the upper or lower table, the difference in height between the upward convex flexing peak in the middle of the lower table and the portions of the lower table in contact with the side edges of the sheet remains within a predetermined tolerance.

Advantageously, the length $l_0$ is defined so that the portion of the table between the closed ends of the slots is suitable for absorbing any stress substantially equal to the maximum stress applied during bending of the sheet without giving rise to elastic deformation of the table provided with the slots. The term "maximum stress" should be understood as a limit stress for which the bending press is dimensioned and that does not give rise to any plastic deformation.

Preferably, the length $l_0$ between the ends of the slots is less than 35% of the length L of the table including said slots. More preferably, said length $l_0$ is substantially equal to 20%±15%, and preferably 20%±5%, of the length L of the table including said slots.

This particular length for the slot-free portion of the table makes it possible on average to obtain effectively no deformation between the center of the sheet and in its ends, for metal sheets for machining and that are of shorter length, close to the length $l_0$.

Preferably, said length $l_0$ is equal to about 80% of the length of a sheet centered on the press for which the deformation curve under the action of the movable table is substantially negligible.

BRIEF DESCRIPTION OF THE DRAWINGS

Other characteristics and advantages of the invention appear better on reading the following description of several embodiments of invention given as non-limiting examples. The description refers to the accompanying figures, in which:

FIGS. 16A-D to 21A-D show the comparative tests.

MORE DETAILED DESCRIPTION

Figure 2:
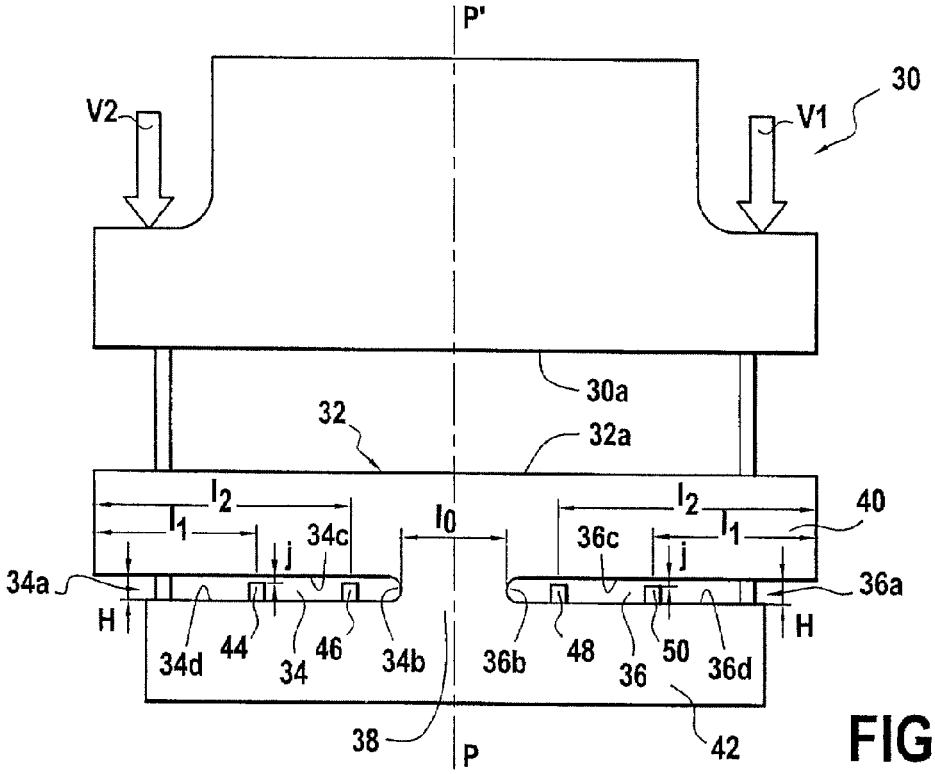
FIG. 2 is an elevation view of a bending press in accordance with the invention, shown at rest.

With reference initially to FIG. 2, there follows a description of the embodiment principles of the deformation compensation system in accordance with the invention as applied to the bending press.

Figure 1A:
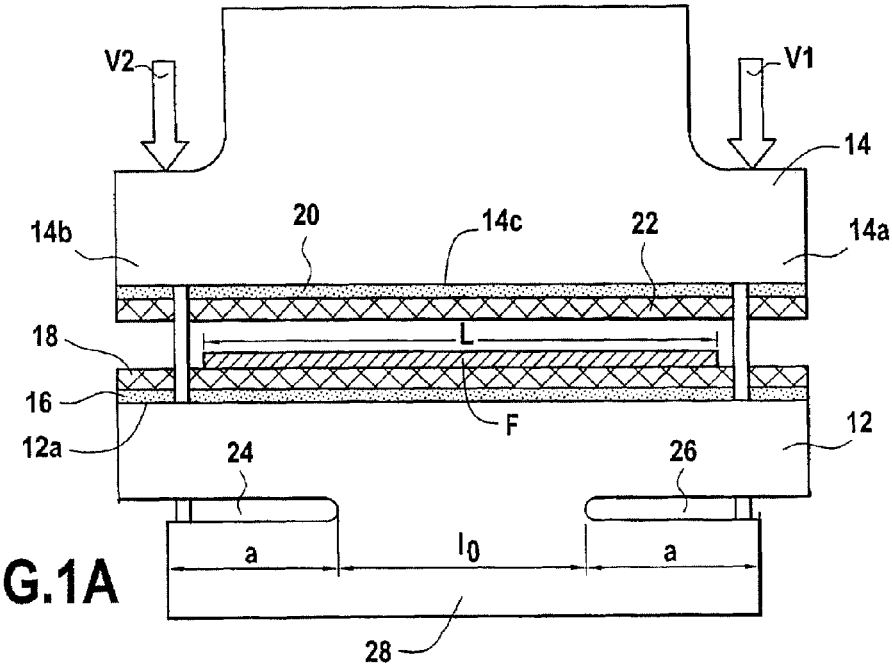
FIG. 1A, described above, it is an elevation view of a bending press of known type.
Figure 1B:
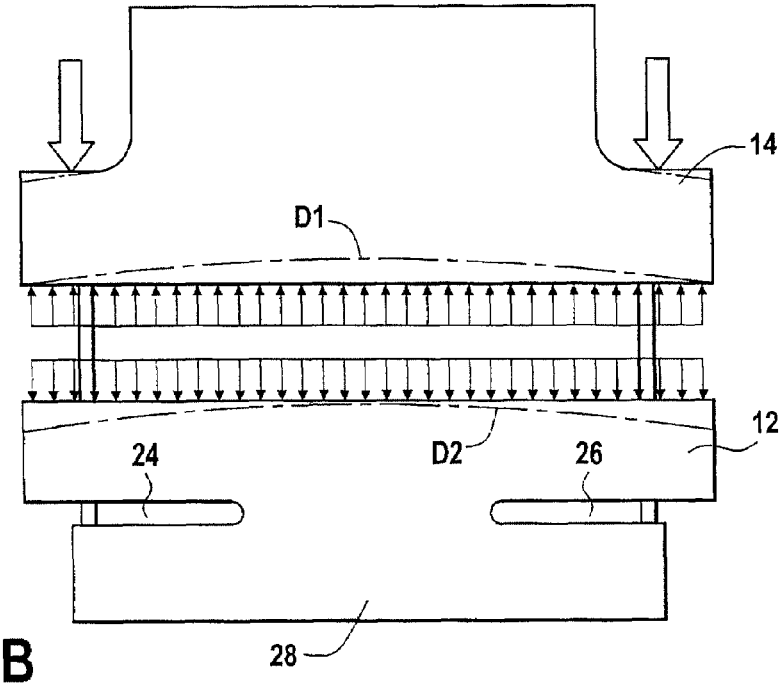
FIG. 1B shows the deformation of the edges of the tables of a standard bending press acting on a sheet having a length that is substantially equal to the length of the tables of the bending press.
Figure 1C:
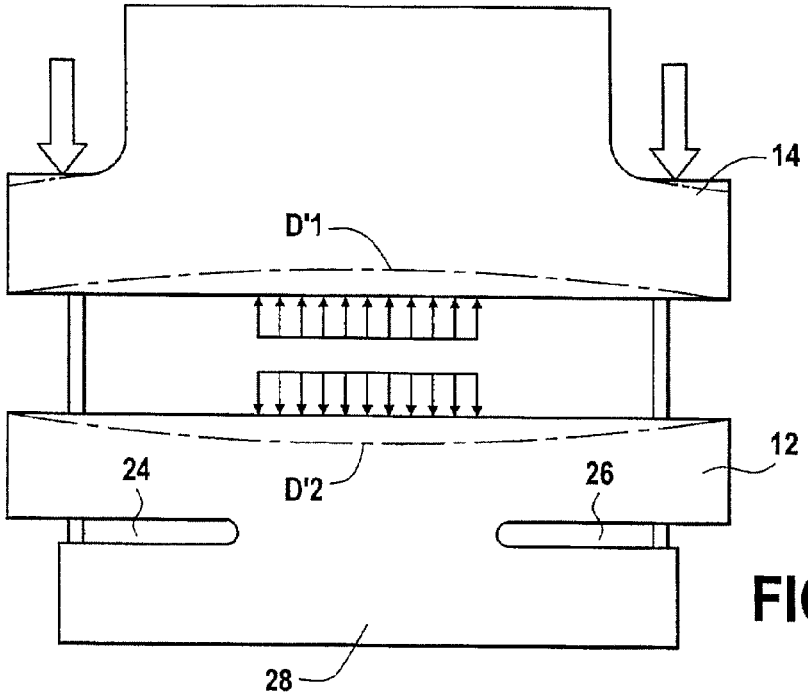
FIG. 1C shows the deformation curves of the edges of the tables of a bending press of known type when acting on a sheet for bending of shorter length.

In FIG. 2, there can be seen the essential elements of the bending press in accordance with the invention and in the absence of any load being applied to the tables. It comprises the movable upper table 30 driven by the actuators $V_1$ and $V_2$ together with the stationary lower table 32. This figure does not show the tool carriers or fasteners that are naturally mounted on the free edges 30*a* and 32*a* respectively of the upper table 30 and of the lower table 32. In the lower table 32, two slots 34 and 36 are formed, each having an open end 36*a*, 34*a* opening out in the lower table, and also a closed end 34*b*, 36*b*. Between them, the closed ends 34*b* and 36*b* of the slots 34 and 36 define a central, slot-free portion 38 of the table constituting an engagement element between a top portion 40 of the table 32 above the slots 34 and 36, and a bottom portion 42. The distance between the closed ends 34*b*, 36*b* of the slots 34, 36 is equal to $l_0$ Naturally, the edges 30*a* and 32*a* of the tables 30 and 32 are fitted with the tool carriers shown in FIG. 1A.

The slots 34 and 36 are preferably parallel to the free edge 32*a*. They are disposed symmetrically about the midplane P'P of the press, this plane being orthogonal to the length of the tables 30 and 32. The slots 34 and 36 thus define top edges 34*c* and 36*c*, and bottom edges 36*d* and 34*d*.

According to the invention, stoppers 44, 46, 48, and 50 are mounted in each of the slots 34 and 36, and they are disposed symmetrically about the midplane P'P. There is thus necessarily an even number of stoppers. In the example shown in FIG. 2, each slot 34, 36 is fitted with two respective stoppers, 44 and 46 for the slot 34, and 48 and 50 for the slot 36. Their respective distances from the ends of the lower table are equal to $l_i$ and $l_2$. The function of the stoppers is to create, at the locations where they are positioned, controlled approaches between the top edges 34*c*, 36*c* and the bottom edges 34*d*, 36*d* of each of the slots 34, 36 under the action of the force applied by the upper table 30. These stoppers 44, 46, 48, and 50 occupy stationary positions within the slots. Below there is a description of a preferred embodiment of the stoppers either serving to define initial clearances, or else more generally serving to control the approach of two edges 34*c* and 34*d* or 36*c* and 36*d* of a single slot 34, 36. It needs specifying here that the stoppers 46 and 48 that are closer to the closed ends of the slots 34*b*, 36*b* define an approach capacity for the edges 34*c* & 34*d* or 36*c* & 36*d* of the slots 34 or 36 that is smaller than the capacity defined by the stoppers 44 and 50 that are closer to the open ends 34*a* and 36*a* of the slots. Each stopper 44, 46, 48, 50 is made of a suitable material and presents a horizontal section such that the elastic deformation of the stopper under the effect of a force that is applied thereto obeys a well-determined relationship that corresponds at least in part to the correction that it is desired to obtain.

To finish off describing the general definition of the system for stabilizing deformation of the upper and lower tables 30 and 32, it should be added that the length $l_0$ of the engagement zone 38 between the two slots 34 and 36 is considerably shorter than the length of the same zone in previously-known devices.

The engagement zone 38 has a length $l_0$ that is short, but nevertheless sufficient to absorb the maximum stress that is applied while bending a sheet.

Preferably, the length $l_0$ is less than 90% of the total length of the table 30 or 32 that includes the slots 34 and 36, generally the lower table 32. Naturally, this length $l_0$ depends on the thickness of the table in the direction orthogonal to the plane of the figures. More preferably, the length $l_0$ lies in the range 15% to 25% of the total length of the table 32. It can also be readily understood that for presses of short length, e.g. of length shorter than 2 m, the percentage should be towards the high end of the range.

Also preferably, the length $l_0$ may be defined as follows:

the length $l_0$ corresponds to at least 80% of the length of a metal sheet or lamination that, while being bent over its entire length, gives rise to no significant deformation of the free edges 30*a* and 32*a* of the upper and lower tables 30 and 32, providing the metal sheet or lamination is centered on the midplane P'P. From a practical point of view, the width of such a sheet or lamination is about 80 centimeters (cm) such that the length $l_0$ is of the order of 65 cm for upper and lower tables 30 and 32 that present a total length equal to 3 m, which corresponds to a standard length for a bending press.

Thus, as explained above, the function of each stopper 44, 46, 48, and 50 is to control the approach of the edges 34*c* and 36*c* of each slot 34 and 36 while the bending force is being applied. By controlling the approach of the edges 34*c* and 34*d* or 36*c* and 36*d* of the slot 34 or 36, the deformation of the top edge 34*c* or 36*c* of the slot 34 or 36 is controlled, and consequently the deformation of the top edge 32*a* of the lower table 32 is controlled, assuming that it is the lower table that is provided with the slots 34 and 36.

This approach is controlled with the help of the stoppers 44, 46, 48, and 50 as a result either of initial clearance j as defined by the stopper, or of the elastic deformation of the stopper under the effect of the stress, or indeed of a combination of both. By acting on these two parameters, it is thus possible to obtain great accuracy in the deformation of the lower table for a very wide variety of lengths of metal sheet.

FIGS. 7A to 7D are curves plotting the decrease d in the distance between the edges of the slot as a function of the force F for different combinations of the above-specified parameters.

Tests that have been performed show that suitable initial clearance j, if any, is less than 1 mm, even for bending presses of great length, typically 6 m. With presses of more standard length, of the order of 3 m, this clearance, if any, is found to be less than 0.8 mm.

Figure 7A:
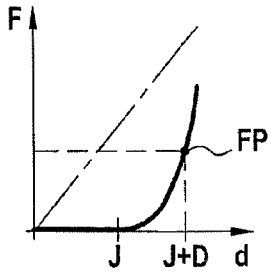
FIGS. 7A, 7B, 7C, and 7D are curves showing how the distance between the edges of a slot vary as a function of the applied force for various different initial settings.

FIG. 7A shows the reduction in the distance d between the two edges 34*c* and 34*d* or 36*c* and 36*d* of the slot 34 or 36 (along the abscissa) as a function of the applied force F (up the ordinate) in circumstances involving both elimination of the initial clearance j and the elastic deformation D of the stopper. On the curve, the point FP corresponds to the end of bending.

Figure 7B:
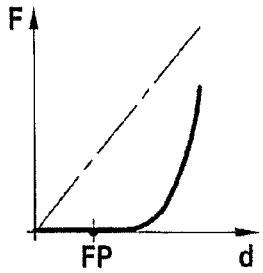

FIG. 7B corresponds to the circumstances in which the end of bending FP occurs before the clearance j has been completely eliminated. There is no elastic deformation of the stopper. This situation may be encountered with metal sheets that are very short, or when there are two or more stoppers per slot and the zone for which FIG. 7B is established is further from the closed end of the slot.

Figure 7C:
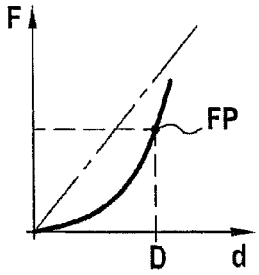

FIG. 7C corresponds to circumstances in which the initial adjustment of the stopper makes no provision for any clearance j. The reduction in the distance d then results solely from the elastic deformation D of the stopper.

Figure 7D:
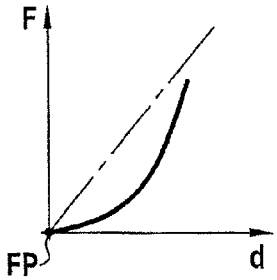

FIG. 7D corresponds to the particular situation in which there is no the initial clearance and in which there is no elastic deformation of the stopper. This situation is encountered only when folding a metal sheet that is off-center relative to the midplane P'P.

Tests performed with a bending press of the above-described type show that regardless of the length of the sheet, and to some extent regardless of the way it is centered relative to the midplane P'P, substantially parallel deformations are obtained of the free edges 30*a*, 32*a* of the upper and lower tables 30 and 32 because of the way the stoppers 44, 46, 48, and 50 act, because of their correct positioning $l_i$ and $l_2$ in the slots 34 and 36, and because of the initial clearance j provided.

Figure 3:
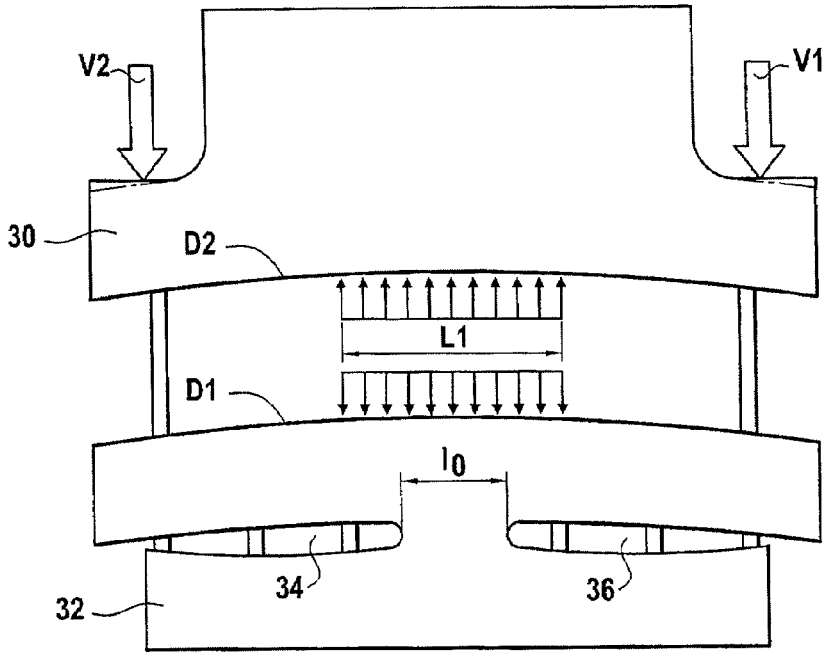
FIG. 3 is an elevation view of the bending press, showing the deformation curves when the sheet for bending is of short length.

As shown in FIG. 3, with a sheet of short length $L_1$, the two deformations $D_2$ and $D_1$ of the edges 30*a*, 32*a* of the upper and lower tables 30 and 32 are substantially parallel, in particular because of the specific choice made for the length $l_0$ of the engagement zone 38.

Figure 4:
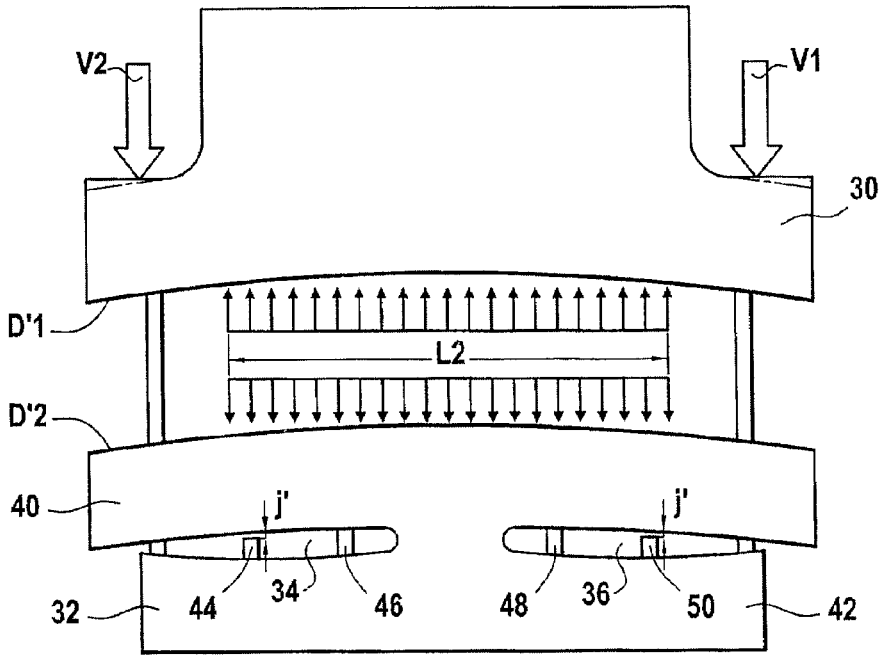
FIG. 4 is a view analogous to FIG. 3, showing the deformation curves when acting on a sheet of intermediate length.

As shown in FIG. 4, for a sheet of length $L_2$ lying between the total length of the tables and the minimum length, under the effect of the stresses applied by the upper table 30, the deformation of the top portion 40 of the lower table 32 causes the clearance j corresponding to the stoppers 46 and 48 that are closest to the closed ends 34*b* and 36*b* of the slots 34 and 36 to be eliminated and/or causes them to be deformed elastically. In contrast, for the length of sheet under consideration, a certain amount of clearance j' remains in the stoppers 44 and 50, as shown in FIG. 4, i.e. there is no elastic deformation. For this length of sheet, tests have been performed that show that the deformations of the free edges 30*a* and 32*a* of the upper and lower tables 30 and 32 are substantially parallel.

Figure 5:
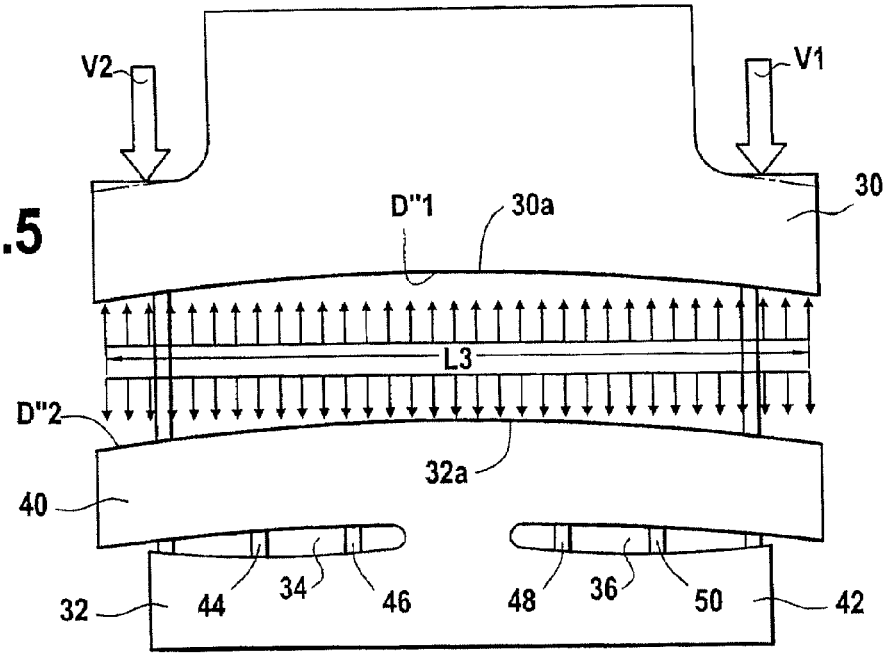
FIG. 5 is an elevation view of the FIG. 3 bending press, showing the deformation curves when acting on a sheet of length close to the length of the tables.

FIG. 5 shows the deformation of the free edges 30*a* and 32*a* of the upper and lower tables 30 and 32 when working a metal sheet or lamination of length $L_3$ that is substantially equal to the total length of the upper and lower tables 30 and 32. Under such circumstances, the clearances j in the stoppers 46 and 48 are eliminated and/or the stoppers 46 and 48 are deformed, and then towards the end of force being applied, the clearances defined by the stoppers of 44 and 50 are in turn eliminated, and/or the stoppers 44 and 50 are deformed elastically. Thus, as shown by tests that have been performed, the free edges 30*a* and 32*a* of the upper and lower tables 30 and 32 remain substantially parallel when they are deformed.

Tests performed using a machine of the above-described type show that when there is a need to bend a part that needs to be off-center relative to the midplane P'P of the press, a mode of operation is obtained that is very similar to that described above, and that corresponds to the sheets for bending being in positions that are centered.

Figure 8:
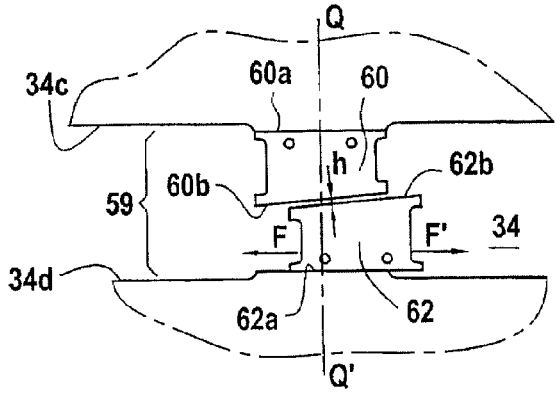
FIG. 8 is an elevation view of a preferred embodiment of a stopper.

FIG. 8 shows a preferred embodiment for the stoppers. The stopper 59 of FIG. 8 is constituted by two wedges 60 and 52 facing each other. In a preferred embodiment, the top wedge 60 has a top end 60*a* that is secured to the top edge 34*c* of the slot 34 without any freedom of movement. The other end 60*b* of the wedge 60 presents a face that is slightly inclined. The second wedge 62, which together with the first wedge 60 forms the stopper 59, has a bottom end 62*a* that is mounted to slide on the bottom edge 34*d* of the slot 34. The bottom wedge 62 also presents a second end 62*b* that is inclined relative to the edge 34*d* of the slot 34 and parallel to the inclined surface 60*b* of the top wedge 60. The functional position of the above-defined stopper 59 is stationary and corresponds to the midplane Q'Q of the top wedge 60, which plane is parallel to the plane P'P. The limited movements of the bottom wedge 62, represented by arrows F, F', make it possible to vary the distance j between the respective sloping ends 60*b* and 62*b* of the two wedges 60 and 62 in the plane Q'Q. This possibility of moving the bottom wedge 62 as explained above does not serve under any circumstances to allow the functional position of the stoppers 59 to the moved, it serves merely to adjust very accurately the clearance j that is defined by the stopper, i.e. the distance between the respective sloping ends 60*b* and 62*b* of the two wedges 60 and 62. In an embodiment in accordance with FIG. 6, the clearance may be adjusted to within 100th of a millimeter. The two wedges 60 and 62 constituting the stopper 59 are made of a material that enables a force of several hundreds of thousands of newtons to be transmitted between the two edges 34*c* and 34*d* or 36*c* and 36*d* of the slots 34 and 36 of the lower table 32, regardless of the force that is applied by the actuators $V_1$ and $V_2$.

Figure 9:
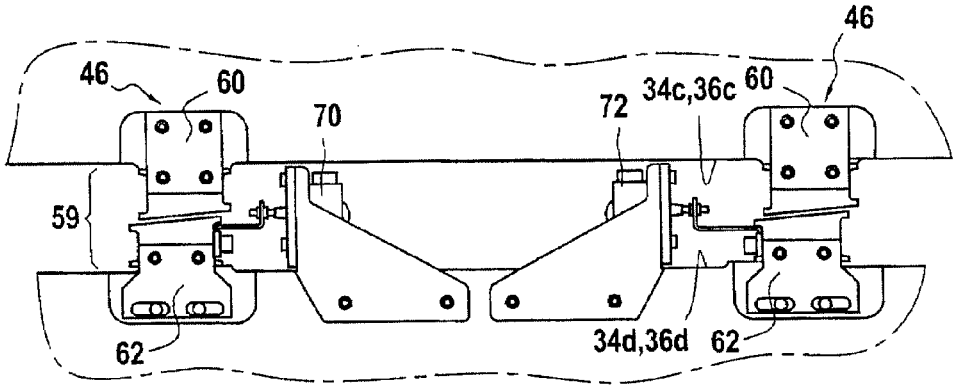
FIG. 9 is an elevation view of two stoppers provided with a motor-driven control system for adjusting the position of the clearance associated with the stoppers.

FIG. 9 shows an embodiment of the wedges 62 in which movement is motor-driven. The top wedges 60 of the stoppers 59 are stationary relative to the top edge 34*c* or 36*c* of the slot 34 or 36. The bottom wedges 62 of the stoppers 59 a movable in translation relative to the bottom edge 34*d* or 36*d* of the slot 34 or 36. Actuators 70 and 72 serve to control the movement of the movable wedges 62.

In the above-described preferred embodiments, the upper table 30 is movable while the lower table 32 is stationary. Naturally, the inverse configuration would not go beyond the invention, i.e. the configuration in which the upper table is stationary while the lower table is movable.

In the same manner, the slots 34 and 36 are made in the lower table 32. Naturally, these slots 34 and 36 could be made in the upper table 30, regardless of whether it is movable or stationary, providing the same rules are applied for placing the stoppers 44, 46, 48, 50, or 59 and for defining the engagement zone 38 between the closed ends 34*b* and 36*b* of the two slots 34 and 36.

Figure 6:
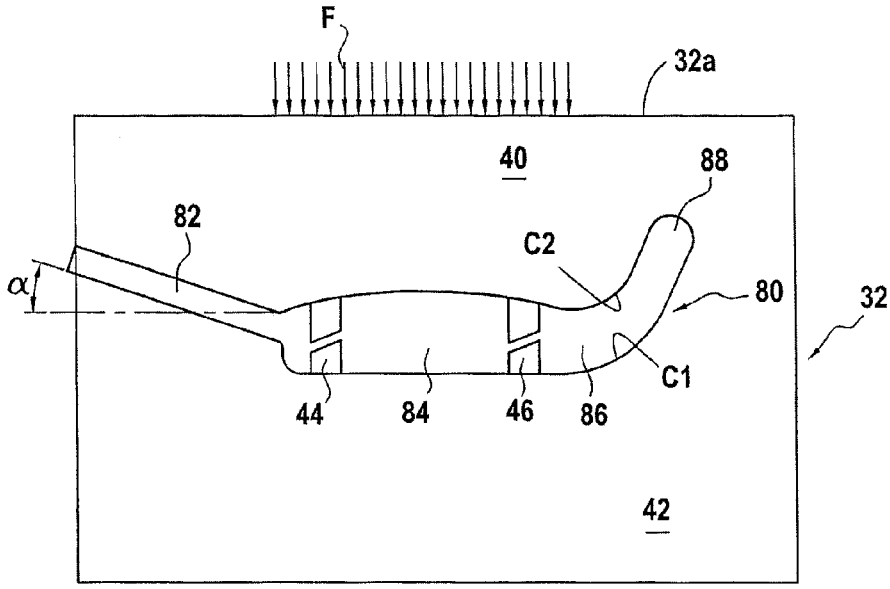
FIG. 6 is a fragmentary view of the lower table of the press, showing a preferred shape for the slot.

In the preceding figures, the slots 34 and 36 are shown as being substantially parallel to the edge 32*a* of the lower table 32, and of width that is substantially constant. Nevertheless, it may be advantageous to provide slots of a different shape, in particular in order to reduce stresses in the table that has the slots, preferably the lower table 32, under the action of forces on the other table 30. This is what is shown in FIG. 6.

In the figure, there can be seen the top portion 40 of the lower table 32 and the bottom portion 42 of the table 32. In the figure, the slot is given reference 80.

In this embodiment, the slot 80 has a first portion 82 opening out into the side of the table 32, a middle portion 84, and a third portion 86 terminating at the closed end 88 of the slot 80.

The first portion 82 of the slot is substantially rectilinear, of height that is substantially constant, and inclined relative to the edge 32*a* of the table by an angle $\alpha$. This serves to reduce the second moment of area of the end of the top portion 40 of the lower table 32.

The intermediate portion 84 is essentially determined to facilitate positioning and assembling the stopper(s), e.g. the stoppers 44 and 46. For this purpose, its height is greater than the height of the portion 82.

The third portion 86 presents the closed end 88 in the form of a portion of a circle of radius that is determined so as to decrease stresses. The remainder 80 of the third portion 86 is preferably defined by two curved zones $C_1$ and $C_2$ that also serve to limit stresses.

The adjustments of the stoppers, i.e. their capacities for controlling the approach of the edges of the slot by means of the initial clearance and/or by means of elastic deformation, are particularly well adapted to circumstances in which the sheet for bending is placed symmetrically relative to the midplane of the press. Under such circumstances, the adjustments of symmetrical stoppers are identical. When the sheet is positioned in slightly asymmetrical manner, the symmetrical adjustments of the stoppers may suffice.

If there is a large amount of asymmetry, different adjustments may be provided for stoppers disposed symmetrically about the midplane. Another solution consists in providing identical adjustments for symmetrical stoppers and in providing different amounts of movement for the two ends of the movable table, usually the upper table. This result may be obtained by applying different controls to the actuators $V_1$ and $V_2$ so that, at the ends of their strokes, the movements of the ends of the movable table are different.

It is naturally possible to combine different initial adjustments for symmetrical stoppers and different amounts of movement for the two ends of the movable table.

Figure 10:
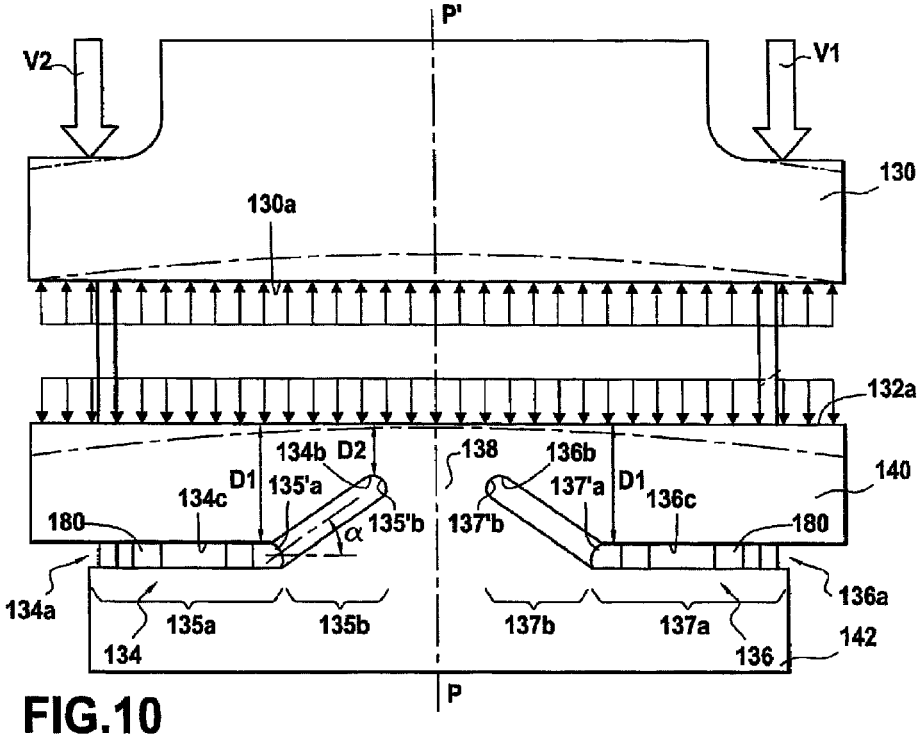
FIG. 10 shows a variant bending press of the invention.

There follows a description of FIG. 10. In this figure, elements analogous to those of the preceding figures are designated by the same references, plus 100. The lower table 132 has two slots, respectively 134 and 136, which slots are disposed symmetrically about the midplane P'P of the press.

The respective outside ends 134*a* and 136*a* of the slots 134 and 136 are open.

It can be seen that adjustment elements 180 are disposed in the slots 134 and 136. For example, each adjustment element may be constituted by a wedge, and as in the example described above, in particular with reference to FIG. 8, it may comprise firstly top blocks mounted in the top portions of the slots and laterally adjustable in the lower table 132, and secondly bottom blocks mounted in the bottom portions of the slots and laterally adjustable in said table. Furthermore, as in those examples, the bottom and top blocks may have contact faces that are inclined. As mentioned above, by adjusting the lateral position of contact between these inclined faces of the bottom and top blocks, it is possible to make an adjustment such that, during bending, the flexing of the lower table 132 follows the convex flexing of the upper table 130, to the detriment of the clearance between the inclined faces of the bottom and top blocks, and/or their levels of compression in the vertical direction while a sheet is being bent.

It should be understood that the adjustment elements 180 may be of a configuration other than that described above. Any determined combination of bottom and top wedge elements may be involved.

It should be observed that each of the slots 134 and 136 has a respective first slot portion 135*a* and 137*a*, and a respective second slot portion 135*b* and 137*b*. For each slot, the respective second portion 135*b* or 137*b* is the portion that is situated on the inside (closer to the midplane P'P) relative to the first slot portion. For each slot, the second slot portion is connected to the first slot portion. More precisely, each first slot portion, respectively 135*a* and 137*a*, is connected via its inside end, respectively 135'*a* and 137'*a*, to the second slot portion, respectively 135*b* and 137*b*. It can be seen that the vertical distance $D_1$ between the bottom ends respectively 135'*a* and 137'*a* of the first slot portions and the tool fastener 132*a* of the table 132 is greater than the vertical distance $D_2$ between the inside ends, respectively 135'*b* and 137'*b*, of the second slot portions and said tool fastener 132*a*.

It can be seen that the first and second slot portions are inclined relative to each other.

More precisely, the first slot portions, respectively 135*a* and 137*a* present a general direction that is horizontal, while the second slot portions, respectively 135*b* and 137*b* are inclined towards the tool fastener 132*a*. In the example shown, the second slot portions, respectively 135*b* and 137*b*, are in the form of rectilinear segments that are inclined at an angle $\alpha$ of about 45° relative to the horizontal direction of the first slot portions. By way of example, the angle $\alpha$ may lie in the range 10° to 60°.

The above-mentioned adjustment elements 180 are situated in the first slot portions, respectively 135*a* and 137*a*.

Figure 11:
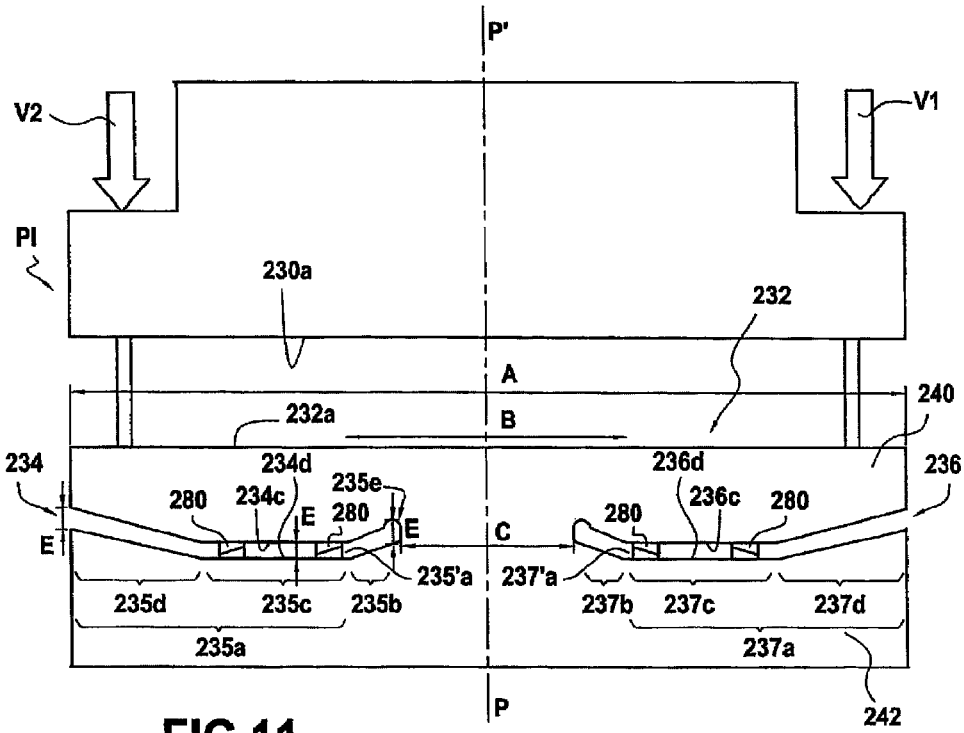
FIG. 11 shows another variant bending press in a second aspect of the invention.

There follows a description of FIG. 11, in which elements that correspond to those of FIG. 10 are designated by the same numerical references, plus 100. The bending press of FIG. 11 differs from that of FIG. 10 by having slots 234 and 236 of a slightly different shape. The respective first portions 235*a* and 237*a* of each of the slots 234 and 236 include respective segments 235*c* and 237*c* of a generally horizontal direction with respective inside ends 235'*a* and 237'*a* connected to respective second slot portions 235*b* and 237*b*. The segments form inside portions of the first slot portions. In addition to the segments of generally horizontal direction, the first slot portions also include respective outer slot portions 235*d* and 237*d*. The outer portions are inclined so as to come closer to the tool fasteners 232*a* than the above-mentioned segments, respectively 235*c* and 237*c*. Specifically, with the slots formed in the lower table, the outer portions of the slots rise upwards as they go away from the respective second slot portions.

It can be seen that the wedging elements 280 are situated in the segments 235*c* and 237*c* of the first slot portions that extend in a generally horizontal direction.

It can be seen that the vertically-measured width E of each slot differs depending on the zone of the slot in which the width is measured. In this respect, the slot 234 is described in greater detail. At least one of the slot portions 235*a* and 235*b* presents a width that varies depending on the zone of said portion in which the width is measured. Specifically, the width E is at a minimum and is substantially constant in the segment 235*c* of the first slot portion 235*a* that extends in a generally horizontal direction. In contrast, the width varies both in the outer slot portion 235*d* and in the second slot portion 235*b*. Specifically, it can be seen that the width E increases regularly in the outer slot portion 235*d* on going outwards away from the segment 235*c*. Specifically, the top and bottom edges, respectively 234*c* and 234*d*, of the slot 234 present, in the outer slot portion and 235*d*, the shape of non-parallel sloping planes that diverge towards the outside.

Similarly, the second slot portion 235*b* presents at least one portion that is flared going away from the first slot portion 235*a*. It can thus be seen that the width E is greater beside the inside end of said second slot portion 235*b* than beside its outer end, corresponding to the inside end 235'*a* of the first slot portion 235*a*. Specifically, the top and bottom edges 234*c* and 234*d* of the slot 234 present, in the second slot portion 235*b*, the shape of non-parallel planes diverging towards the midplane P'P, all the way to the inner end portion 235*e*, which is in the form of a portion of a ball.

Naturally, the slot 236 is symmetrical to the slot 234 about the midplane P'P.

Figure 12:
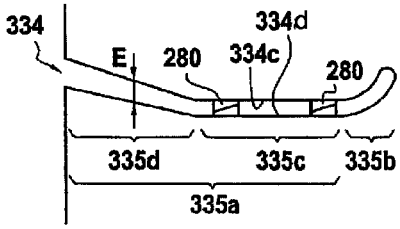
FIGS. 12 to 14 are views on a larger scale of slots in variant embodiments.

With reference to FIG. 12, it can be understood that the slot 334 may be of a shape that is slightly different from the shape of the slot 234. In the example shown, the first slot portion 335*a* of the slot 334 is analogous to the first slot portion 235*a* of the slot 234. The second slot portion 335*b* is of a shape very close to the shape of the second slot portion 235*b*, except that in this second slot portion 335*b*, the top and bottom edges 334*c* and 334*d* are of curved shapes, with their concave sides directed towards the tool fastener. Thus, overall, the second slot portion 335*b* presents a curved shape with its concave side directed towards the tool fastener. The width E may vary within the slot 334 as for the slot 234. It should be observed that the slot outer portion 335*d* may be present, as in the example shown, or on the contrary it may be absent, with the first slot portion 335*a* then having a direction that is generally substantially horizontal, like the segment 335*c* visible in FIG. 12. This means that this segment continues towards the outside (to the left in FIG. 12) in a rectilinear manner, like the first slot portion 135*a* of FIG. 10.

Figure 13:
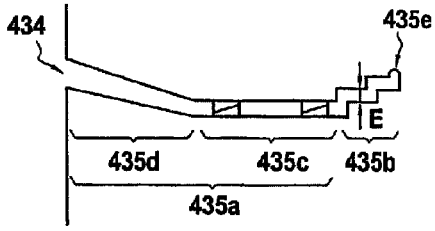

In FIG. 13, it can be seen that the slot 434 has another shape that is slightly different. The first slot portion 435*a* is analogous to the first slot portion 335*a*. Nevertheless, like that first slot portion, it could merely be of a generally horizontal direction, like the segment 435*c*. In contrast, the second slot portion 435*b* presents a staircase shape rising towards the tool fastener on coming closer to the inner end portion 435*e*, which in this example has the shape of a portion of a ball. In the staircase portions, the width E of the slot, measured vertically between the horizontal faces forming the steps of the staircase, may be substantially constant or may increase a little on coming closer to the inner end portion 435*e*.

Figure 14:
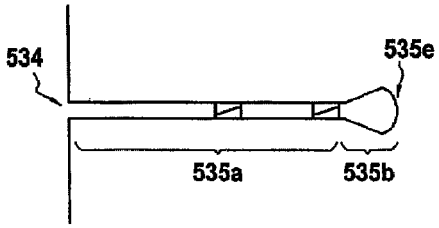

The slot 534 shown in FIG. 14 has another slightly different shape. Specifically, the first slot portion 535*a* is constituted by a single segment presenting a substantially horizontal general direction. Nevertheless, this first portion could present an outer slot portion analogous to the outer slot portion 435*d* of FIG. 13. The second slot portion 535*b* presents a flared shape (generally in the form of a truncated cone) diverging towards the inner end portion 535*e*, which portion has a rounded end. The portion of frustoconical shape may be made with a generator line that is substantially rectilinear, as shown in FIG. 14, or else with a generator line that is curved. Thus, the top edge of the second slot portion comes closer to the tool fastener than does the top edge of the first slot portion.

With reference to FIGS. 12, 13, and 14, it should be understood that only one slot is shown, corresponding to the slot 234 of FIG. 11. Naturally, the other slot is symmetrical to the slot shown about the midplane P'P. Furthermore, the shapes described above are considered in section in a vertical plane, the slots having a vertical section that is constant in vertical planes parallel to the planes of the figures. In these examples, wedging elements analogous to the elements 280 are disposed in the first slot portions.

Figure 15:
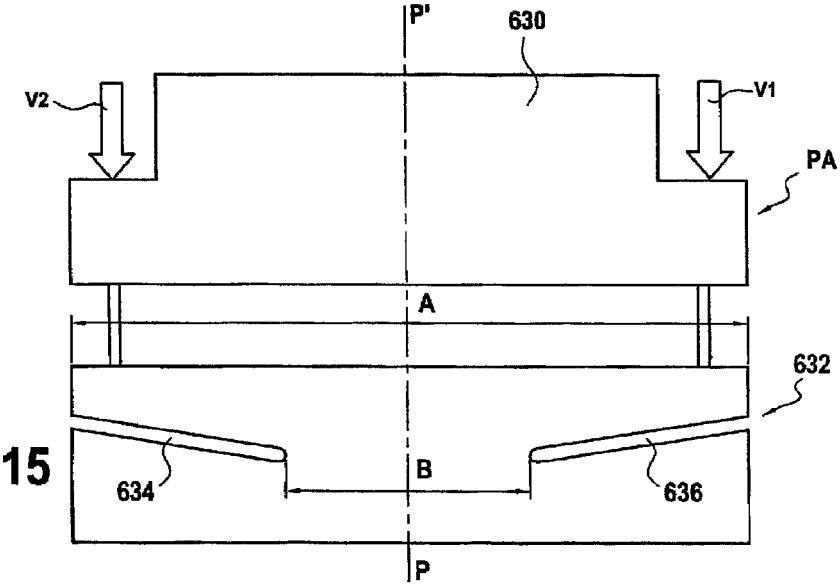
FIG. 15 shows a more conventional press, with which comparative tests were performed.

FIG. 15 shows a more conventional bending press as was used for making comparative tests in comparison with the bending press of FIG. 11. In FIG. 15, the same references are used as in FIG. 2, plus 600. In this figure, the slots 634 and 636 of the lower table 632 are inclined going away from the tool fasteners towards their inner ends that are directed towards the midplane P'P. The angle of inclination of the slots is of the order of 15°, the length A of the tables is the same as in FIG. 11, and the distance B between the inside ends of the slots 634 and 636 is the same as the distance B between the inside ends 235'*a* and 237'*a* of the first slot portions 235*a* and 237*a* of FIG. 11. The tests were performed on grade 304 stainless steel sheets, having a thickness of 12 mm. The bending press tools (matrix) were the same for all of the tests.

FIGS. 16A-D show the results of comparative tests performed with the bending press PA of FIG. 15 (FIGS. 16A and 16B) and with the bending press PI of FIG. 11 (FIGS. 16C and 16D). For these tests, sheets W of width L measured horizontally (in the plane of the figures) were used. The width L was less than the distance C between the inside ends of the slots 234 and 236 of the press PI of FIG. 11. The sheets were folded through 90°.

For all of the tests shown in FIGS. 16A-D to 21A-D, the sheets were placed symmetrically relative to the midplane P'P.

For the curves of FIGS. 16B and 16D, the abscissa is the length of the lower or upper table measured in millimeters, the reference 0 marking the position of the midplane P'P. The ordinate is the flexing of the table measured in millimeters. The convex flexing peak is the highest measured value.

The curve LT shows the flexing of the lower tables respectively 632 for the press PA (FIG. 16B) and 232 for the press PI (FIG. 16D). The curve UT shows the flexing of the upper tables, respectively 630 for the press PA and 230 for the press PI. In FIGS. 16B and 16D, the curve SA shows the differences between the flexing of the upper table and the flexing of the lower table.

In the figures, it can be seen that for bending a sheet W of width L that is less than the distance C between the inside ends of the slots of the bending press PI, there is no significant difference between the bending press PA and the bending press PI.

Figure 17A:
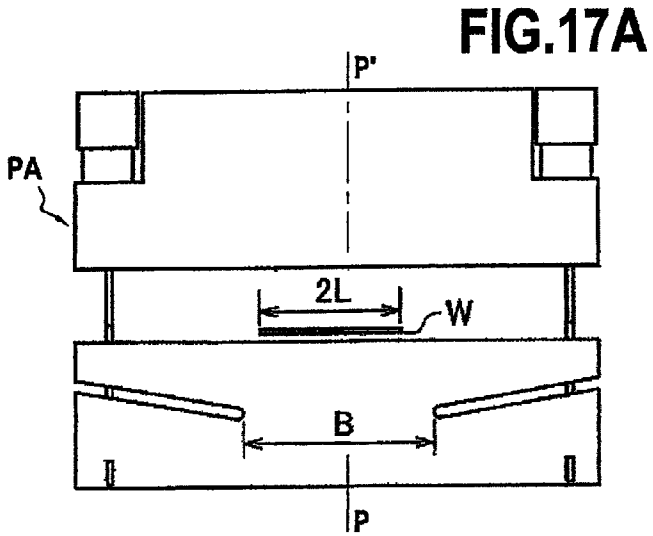
Figure 17B:
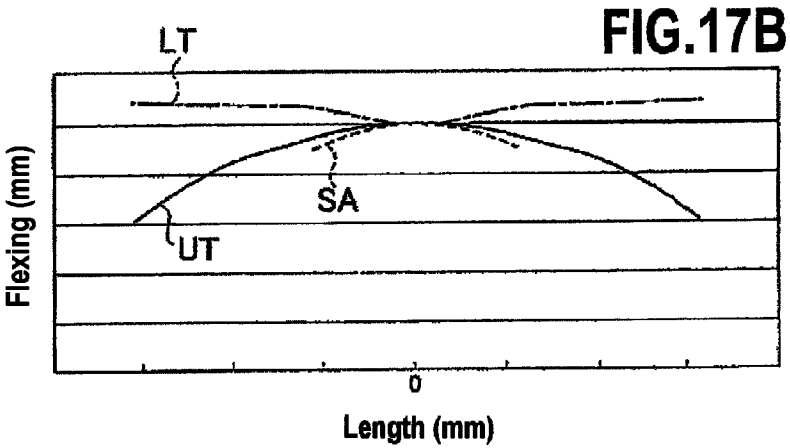
Figure 17C:
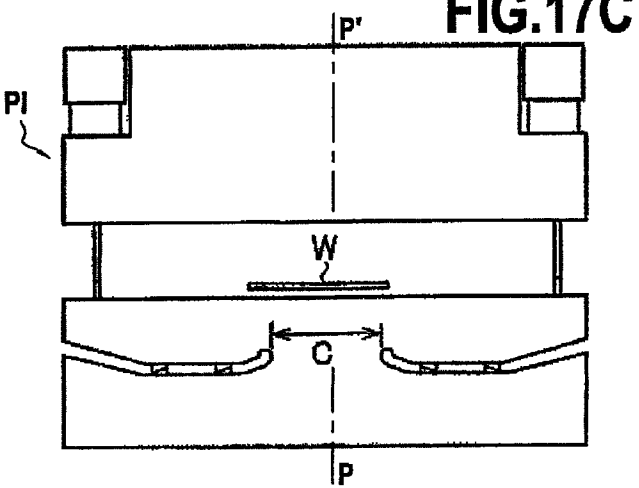
Figure 17D:
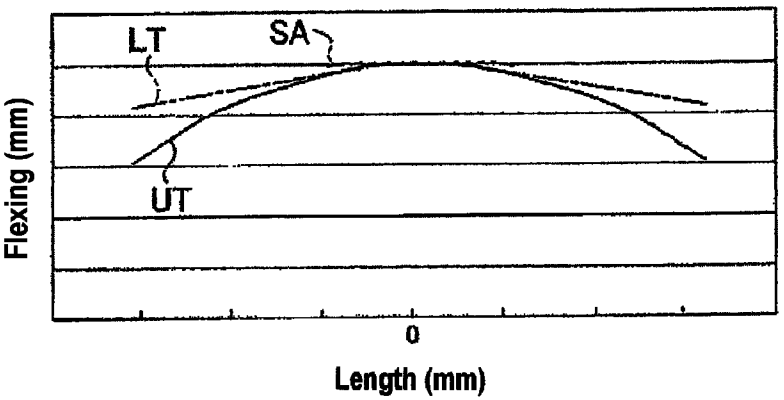

FIG. 17A to D correspond to FIG. 16A to D and the folding in this example was performed on a sheet W of width 2L such that C<2L<B. It should be recalled that B is the distance between the inside ends of the slots of the press PA. By comparing FIGS. 17B and D, it can be seen that with sheets of such a width, the upper table has a tendency to adopt a concave shape, as shown by the curve UT. In contrast, with the bending press PA, FIG. 17B shows that the lower table has practically no tendency to follow this flexing, as shown by the curve LT that is very close to the corresponding curve of FIG. 16B. As a result, with this bending press, the flexing differences between the lower table and the upper table, as represented by the curve SA, are large. In contrast, it can be seen in FIG. 17D, that because of the special configuration of the slots of the bending press PI, the lower table tends to follow the concave flexing of the upper table more closely, as shown by the flexing curve LT relating to said lower table. Thus, in this example, the flexing differences represented by the curve SA are much smaller than those observed in FIG. 17B.

FIG. 18D shows the same tests, but for a sheet W of width 3 such that 3L>B. In this example, the lower table of the press PA still does not follow the concave flexing of the upper table, as shown in FIG. 18B by curves LT relating to the lower table and UT relating to the upper table. The flexing differences represented by the curve SA are thus large. In contrast, and the lower table of the press PI follows more closely the flexing of the upper table, as shown by the curves LT and UT in FIG. 18D. In this figure, the flexing differences represented by the curve SA are thus very small.

Figures 19A, 19B, 19C, 19D:
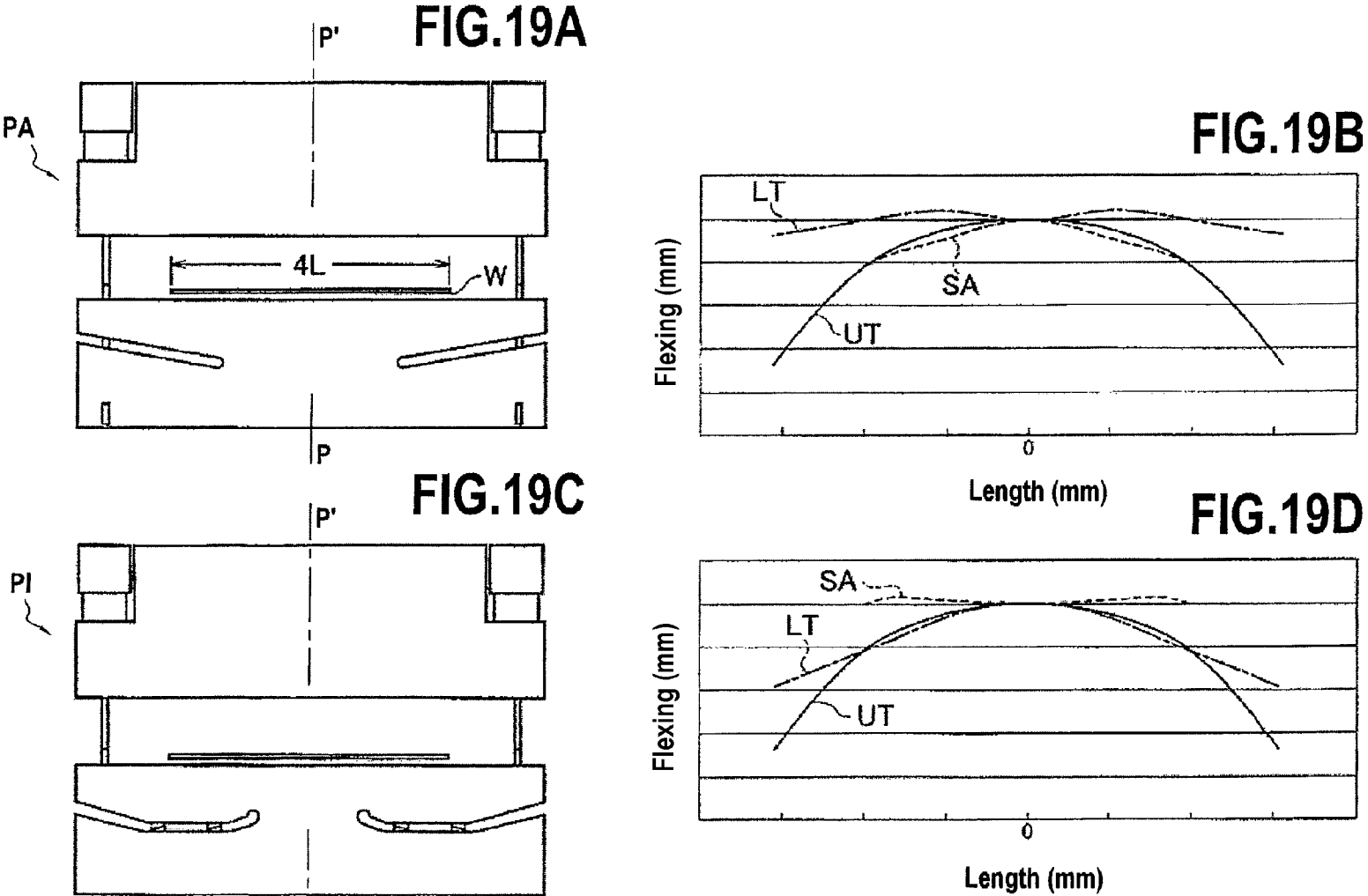
Figure 20A:
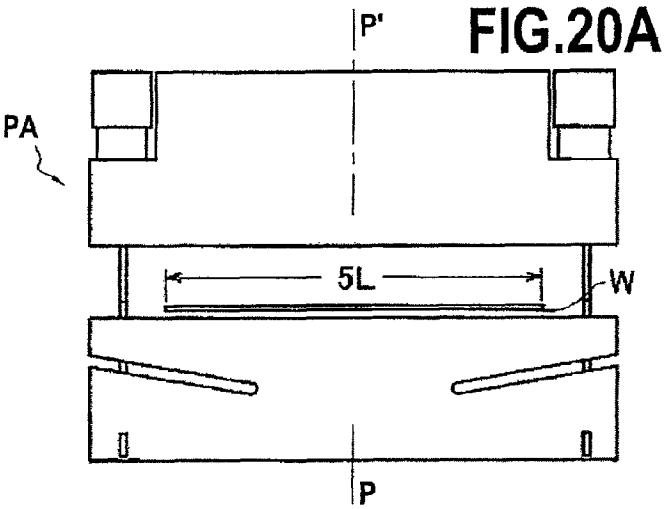
Figure 20B:
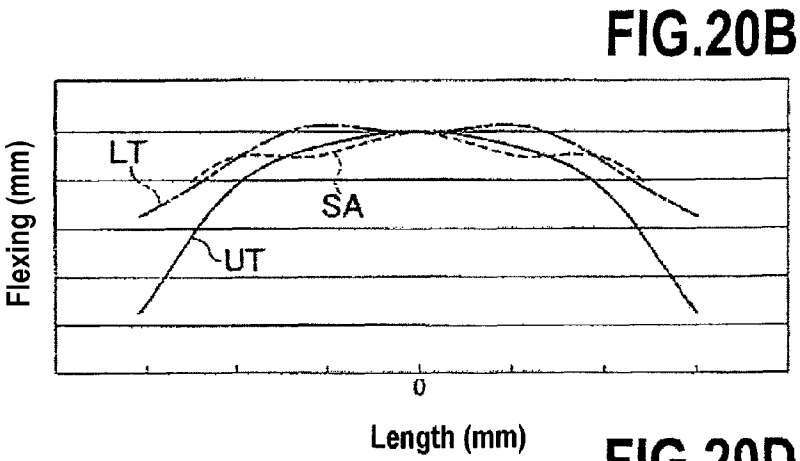
Figure 20C:
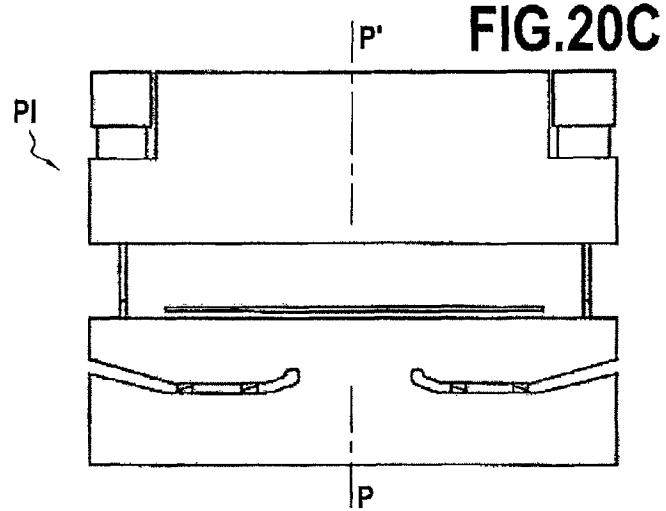
Figure 20D:
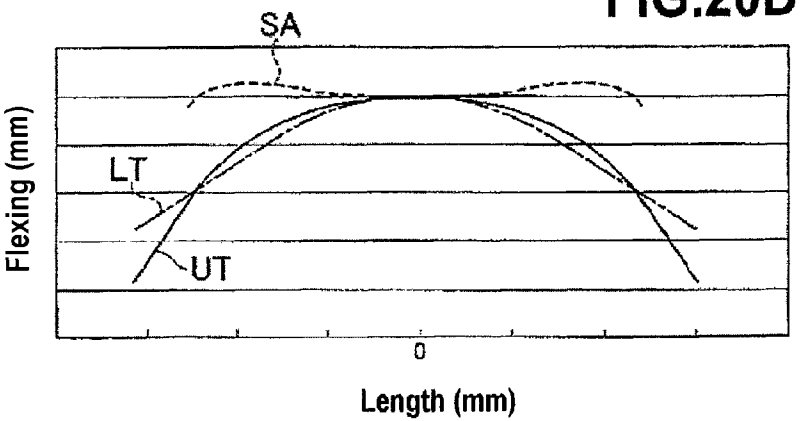
Figure 21A:
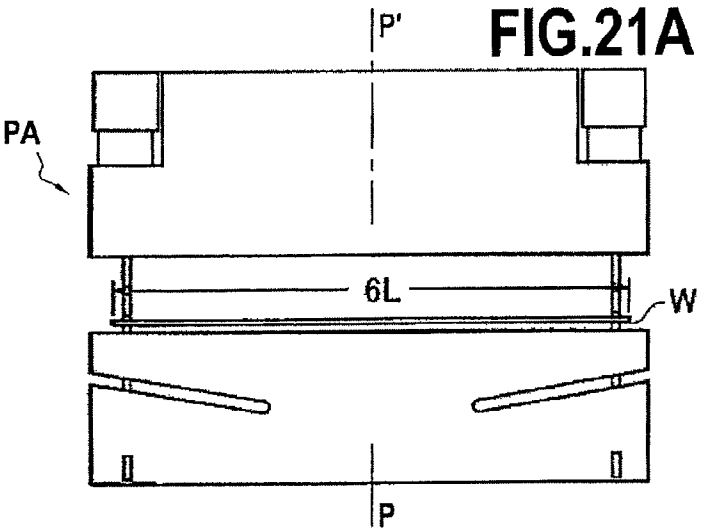
Figure 21B:
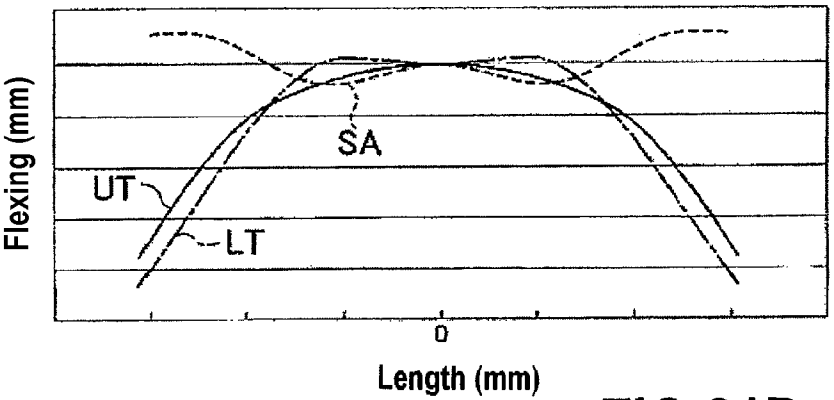
Figure 21C:
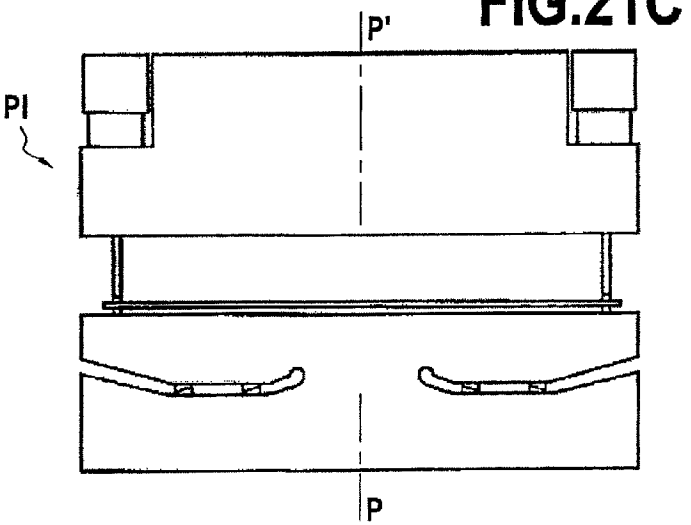
Figure 21D:
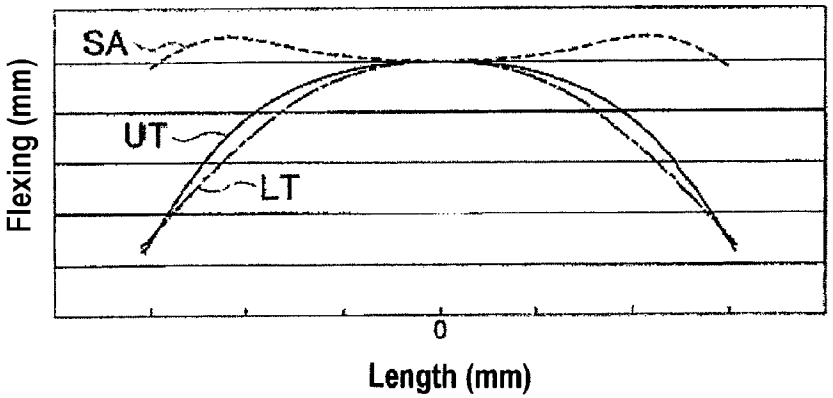

FIG. 19 shows the same tests with a sheet of width 4L. It can be seen in FIG. 19B, that starting from such a width, the lower table of the press PA begins to flex a little, as shown by the curve LT. Nevertheless, this happens to a small extent only and the flexing differences as represented by the curve SA continue to be large in FIG. 19B. This does not apply to FIG. 19D where it can be seen that the lower table of the press PI follows much more closely the flexing of the upper table.

FIG. 20 shows the same tests with a sheet of width 5L. This time, it can be seen that the lower table of the press PA follows the flexing of the upper table better, with the curve LT of FIG. 20B being closer to the curve UT, but the curve SA that shows the flexing differences remains quite marked. In FIG. 20D, the curves LT and UT are closer together, such that the curve SA that shows the flexing differences for the press PI is much flatter.

The behavior of these two presses is somewhat more similar with sheets of width 6L, as shown in FIG. 21A to D.

The above-described comparative tests make it possible to understand that the bending behavior is much more uniform on sheets of a wide variety of widths using a bending press in accordance with the invention, in particular for one as shown in FIG. 11. Bending is thus performed with accuracy that is much better concerning the linearity of the resulting bend. In other words, the bend angle is practically identical over the entire width of the sheet with the bending press of the invention.

For the bending press shown in FIG. 11, it should be observed that the increase in the width of the slots in the outer portions thereof makes it possible to ensure that the lateral ends of the lower table deform more easily. The angles of inclination of the outer portions of the slot are preferably of the order of about 15°, e.g. lying on the range 10° to 20° relative to the horizontal direction. The angle of inclination that is selected depends in particular on the shape and/or the dimensions of the tables, and/or the tolerance range acceptable for deformation of the table having the slots, and/or the accuracy desired for the bending of the part. With slots having this shape, the distance between the slot and the tool fastener is greatest in the region of the substantially horizontal segment of the first slot portion. Thus, in the region of this horizontal segment, the stiffness of the lower table is greater than the stiffness presented by said table in the regions of the other slot portions.

In general, in the invention, the bending press is made so that the stiffness of the table having the slots is greater in the regions of the slots that correspond to the first slot portions (in any event for the substantially horizontal segments of said first slot portions) than in the regions that correspond to the second slot portions. The presence of the wedging elements 180 or 280 suitably positioned in the first slot portions serves to further increase this stiffness.

It should be observed that the first slot portions could be of shapes that are slightly inclined or undulating. Nevertheless, these shapes should be selected so that the first slot portions confer on the corresponding region of the table stiffness that is greater than the stiffness of the region of the table that corresponds to the second slot portions. The length of the second slot portion, measured perpendicularly to the midplane P'P advantageously lies between about one third and about half the total length of the slot. The selected length depends in particular on the shape and/or the dimensions of the tables, and/or the tolerance range acceptable for deformation of the table that has the slots, and/or the accuracy desired for bending the part. It should be understood that by determining the shape of the slots and their length, and by suitably selecting the wedging elements and their positions, it can be ensured that the difference in height between the upward convex flexing peak in the middle of the lower table and the two lateral ends of the lower table remains within some predetermined tolerance. This is equally applicable when the width of the sheet that is being bent by means of the bending press is substantially equal to the length of the upper or lower table and when the width of said sheet is less than the length of the upper or lower table.

In the bending presses of FIGS. 10 to 14, it should be observed that the length between the inside ends of the slots may be of the same order of magnitude as the length $l_0$ described above with reference to FIG. 2.

What is claimed is:

1. A bending press comprising an upper table provided with a fastener for upper tools and a lower table provided with a fastener for lower tools, the two tables being placed edge-to-edge in the vertical direction, and one of the tables being movable relative to the other in the vertical direction, one of the tables presenting slots disposed symmetrically relative to the midplane, each slot having an open outside end and comprising a first slot portion and a second slot portion that is situated on the inside relative to the first slot portion and that is connected thereto, the shapes of said slot portions being such that a stiffness of the portion of the table situated between the slot and the tool fastener is greater between the first slot portion and the tool fastener than it is between the second slot portion and the tool fastener, and at least one element for adjusting the flexing of said table being disposed in the first slot portion.

2. A bending press according to claim 1, wherein a vertical distance between the inside end of the first slot portion whereby the first slot portion is connected to the second slot portion, and the tool fastener, is greater than a vertical distance between the inside end of the second slot portion and the tool fastener.

3. A bending press according to claim 1, wherein the first and second slot portions are inclined relative to each other.

4. A bending press according to claim 2, wherein the first slot portion presents, over at least a segment of said first portion, a general direction that is horizontal, while at least an inside end of the second slot portion, remote from the first slot portion, is oriented towards the tool fastener.

5. A bending press according to claim 4, wherein the second slot portion is inclined towards the tool fastener.

6. A bending press according to claim 1, wherein the second slot portion presents a curved shape with a concave side thereof facing towards the tool fastener.

7. A bending press according to claim 1, wherein the second slot portion presents a staircase shape.

8. A bending press according to claim 1, wherein the first slot portion presents a general direction that is horizontal, and an inside end of the second slot portion is oriented substantially horizontally towards the vertical midplane of the table.

9. A bending press according to claim 1, wherein the second slot portion presents at least one portion that is flared going away from the first slot portion.

10. A bending press according to claim 1, wherein the first slot portion includes an outer slot portion that is inclined so as to be closer to the tool fastener than is an inner portion of the first slot portion.

11. A bending press according to claim 1, wherein at least one of the slot portions presents a width, as measured vertically, that varies along the zone of said slot portion in which the width is measured.

12. A bending press according to claim 1, wherein the inner ends of the first slot portions are positioned in such a manner that while bending a sheet, of width substantially equal to the length of the upper or lower table, the difference in height between the upward convex flexing peak in the middle of the lower table and the two side ends of the lower table remains within a predetermined tolerance.

13. A bending press according to claim 1, wherein the inner ends of the second slot portions are positioned in such a manner that while bending a sheet placed in the middle of the length of the tables, and of width shorter than the length of the upper or lower table, the difference in height between the upward convex flexing peak in the middle of the lower table and the portions of the lower table in contact with the side edges of the sheet remains within a predetermined tolerance.

* * * * *